US007845757B2

(12) United States Patent
Nishiyama

(10) Patent No.: US 7,845,757 B2
(45) Date of Patent: Dec. 7, 2010

(54) PRINTING APPARATUS AND METHOD FOR PRODUCING NOZZLE CLEANING TIME TO IMPROVE THROUGHOUT

(75) Inventor: Toshiyuki Nishiyama, Takarazuka (JP)

(73) Assignee: Seiko Epson Corporation, Tokyo (JP)

( * ) Notice: Subject to any disclaimer, the term of this patent is extended or adjusted under 35 U.S.C. 154(b) by 11 days.

(21) Appl. No.: 12/362,178

(22) Filed: Jan. 29, 2009

(65) Prior Publication Data

US 2009/0195583 A1 Aug. 6, 2009

(30) Foreign Application Priority Data

Feb. 1, 2008 (JP) ..... 2008-023340

(51) Int. Cl.
*B41J 2/165* (2006.01)
*B41J 29/393* (2006.01)

(52) U.S. Cl. ..... 347/23; 347/19

(58) Field of Classification Search ..... 347/23
See application file for complete search history.

(56) References Cited

U.S. PATENT DOCUMENTS

2003/0214659 A1* 11/2003 Niimura ..... 358/1.8
2004/0189737 A1* 9/2004 Nakashima ..... 347/23
2006/0197795 A1* 9/2006 Takatsuka et al. ..... 347/19
2008/0018691 A1* 1/2008 Koase ..... 347/19

FOREIGN PATENT DOCUMENTS

| | | | |
|---|---|---|---|
| JP | 02002014 A | * | 1/1990 |
| JP | 10-119307 | | 5/1998 |
| JP | 2000-272116 | | 10/2000 |
| JP | 2003-118133 | | 4/2003 |
| JP | 2003-191492 | | 7/2003 |
| JP | 2003-205625 | | 7/2003 |
| JP | 2005-262867 | | 9/2005 |

OTHER PUBLICATIONS

English translation of patent document JP 02-002014 A to Akiyama et al.; traslation provided by FLS, Inc. in Apr. 2010, 20 pgs.*

* cited by examiner

*Primary Examiner*—Matthew Luu
*Assistant Examiner*—Shelby Fidler
(74) *Attorney, Agent, or Firm*—Workman Nydegger

(57) ABSTRACT

A printing apparatus including printheads arranged along a transport path of a printing medium and which are transported in a transporting direction. The printheads have a plurality of nozzles arranged in an arrangement which intersects the transporting direction. The apparatus also includes a printhead control unit configured to print an image on the printing medium by discharging ink from part of the plurality of nozzles on the basis of given image data, and a discharge inspection unit configured to detect any defectively discharging nozzles present in the plurality of nozzles, the printhead control unit specifying specific nozzles which discharge ink for printing the image, determining whether any discharge-defective nozzle is included in the specific nozzles or not, and starting printing of the image when it is determined that no discharge-defective nozzle is included in the specific nozzles.

4 Claims, 7 Drawing Sheets

PRINTING APPARATUS AND METHOD FOR PRODUCING NOZZLE CLEANING TIME TO IMPROVE THROUGHOUT

BACKGROUND

1. Technical Field

The present invention relates to a printing apparatus and a control method. More specifically, the invention relates to a printing apparatus configured to print images on a printing medium by discharging ink while transporting the printing medium and a method of controlling the printing apparatus.

2. Related Art

A printing apparatus configured to print images on a printing medium by discharging ink from nozzles might suffer from discharge failure caused by increased viscosity of ink or the like occurring in nozzles during downtime. When the discharge failure occurs, the quality of printed images is deteriorated, and hence the printing apparatus is provided with a function to clean the nozzles for the purpose of solving the discharge failure. However, the cleaning is a time-consuming job and, in addition, a large amount of ink is consumed in many systems. Therefore, it is not preferable to execute the cleaning excessively.

In JP-A-10-119307, a detecting method for optically detecting ink discharge failure is disclosed. In JP-A-2000-272116, an ink jet printer configured to detect automatically a defect of ink nozzles from a printed sample is disclosed. In JP-A-2005-262867, detection of discharge failure by an induced current generated when charged ink adheres to a sensing unit formed of a conductor is disclosed. These technologies allow users to know whether execution of the cleaning is needed or not. In other words, the cleaning is executed only when it is necessary, and hence excessive execution of the cleaning is prevented.

However, in the case of a printing apparatus configured to print high-quality images at high speed, a printhead tends to be upsized due to the increase in number of nozzles. Therefore, the time required for the cleaning is increased and, in addition, the quantity of ink to be consumed by the cleaning is also increased.

SUMMARY

According to a first aspect of the invention, there is provided a printing apparatus having printheads being arranged along a transport path of a printing medium transported in a transporting direction and having a plurality of nozzles arranged in the direction of arrangement which intersects the transporting direction; a printhead control unit configured to print an image on the printing medium by discharging ink from part of the plurality of nozzles on the basis of given image data; and a discharge inspection unit configured to detect any discharge-defective nozzle present in the plurality of nozzles, the printhead control unit specifying specific nozzles which discharge ink for printing the image, determining whether any discharge-defective nozzle is included in the specific nozzles or not, and starting printing of the image when it is determined that no discharge-defective nozzle is included in the specific nozzles. Accordingly, unnecessary cleaning operation is eliminated and quick start of printing of images is achieved. Therefore, improvement of the throughput involved in printing of images is achieved.

Preferably, the printhead control unit determines nozzles which are not determined as the specific nozzles and include discharge failure as non-output defective nozzles, and causes the non-output defective nozzles to discharge ink which does not form any image in parallel with the printing of the image. The printhead control unit may further causes the nozzles which are not specified by a nozzle specifying unit to discharge ink which does not print any image in parallel with the printing of the image. Accordingly, cleaning of the nozzles which are not in use is executed in parallel with the image printing operation, so that lowering of the frequency of occurrence of discharge failure is achieved.

Preferably, the printhead control unit determines whether the position of the non-output defective nozzle is on the printing medium or not on the basis of the image data and data on the size of the printing medium and, when the position of the non-output defective nozzle corresponds to the position on the printing medium, does not cause the non-output defective nozzle to discharge ink in parallel with the printing of the image and, when the position of the non-output defective nozzle corresponds to the position out of the printing medium, causes the non-output defective nozzle to discharge ink in order to clear the discharge failure in parallel with the printing of the image. Alternatively, when the nozzles specified for certain image data by the nozzle specifying unit is included in nozzles specified for image data given immediately before the image data, a determining unit may inform the fact that the nozzles whose discharge failure is detected are not included in the specified nozzles. Accordingly, the time required for inspecting the nozzles which are used immediately before and are not defective in discharge again is omitted. Therefore, the process time is shortened, and ink consumed when detecting the discharge failure is saved.

Preferably, when a series of image data including specifications of printing media having the different sizes in the direction of arrangement is given, the printhead control unit extracts image data in which the printing media of the same size are specified and causes the images to be printed continuously. Accordingly, when printing the series of image data, the number of times of executing the process to specify the nozzles and the number of times of executing the process to clean the nozzles are reduced, so that improvement of the throughput of printing images is achieved.

Preferably, when the specific nozzles include any discharge-defective nozzle, the printhead control unit causes the cleaning of the plurality of nozzles to be executed. Accordingly, since the detected discharge failure is cleared, a high printing quality is maintained.

In the printing apparatus, a discharge failure detecting unit may execute detection of the discharge failure for the printheads every time when the printheads act in excess of a certain amount of movement. Accordingly, occurrence of the discharge failure is prevented in advance.

In the printing apparatus, the nozzle specifying unit may renew the specification of the nozzles on the basis of the data on the size of the printing medium in the direction of arrangement included in the image data. Accordingly, the processes involved in the specification of the nozzles are reliably executed in an earlier stage of the operation of the printing apparatus.

Also, the printhead control unit may cause the nozzles which are not specified by the nozzle specifying unit to discharge ink after having ended the printing of the image. Accordingly, since the known discharge failure is solved, shortening of time required for the processes to be executed before starting printing is achieved when executing printing of image subsequently.

According to a second aspect of the invention, a method of controlling a printing apparatus having printheads being arranged along a transport path of a printing medium transported in a transporting direction and having a plurality of nozzles arranged in the direction of arrangement which intersects the transporting direction and printhead control unit configured to print an image on the printing medium by discharging ink from part of the plurality of nozzles on the basis of given image data includes: detecting a discharge-defective nozzle present among the plurality of nozzles; specifying specific nozzles which discharge ink when printing the image; and determining whether the specific nozzles include the discharge-defective nozzle or not, and printing of the image is started when a determining unit determines that the specific nozzles do not include any discharge-defective nozzle. Accordingly, unnecessary cleaning operation in the printing apparatus is omitted without depending on hardware, so that quick start of the printing of the image is achieved. Also, by supplying software which executes the method of controlling via a printed medium or a communication network, the above-described advantages are enjoyed by existing printing apparatus.

The summary of the invention described thus far do not include all the characteristics necessary for the invention. Combinations of these characteristics may also be included in the invention.

BRIEF DESCRIPTION OF THE DRAWINGS

The invention will be described with reference to the accompanying drawings, wherein like numbers reference like elements.

DESCRIPTION OF EXEMPLARY EMBODIMENT

The invention will be described below on the basis of an embodiment, the embodiment shown below is not intended to limit the invention described in appended claims. Also, all combinations of characteristics described in the embodiment are not necessarily essential in the solving means of the invention.

Figure 1:
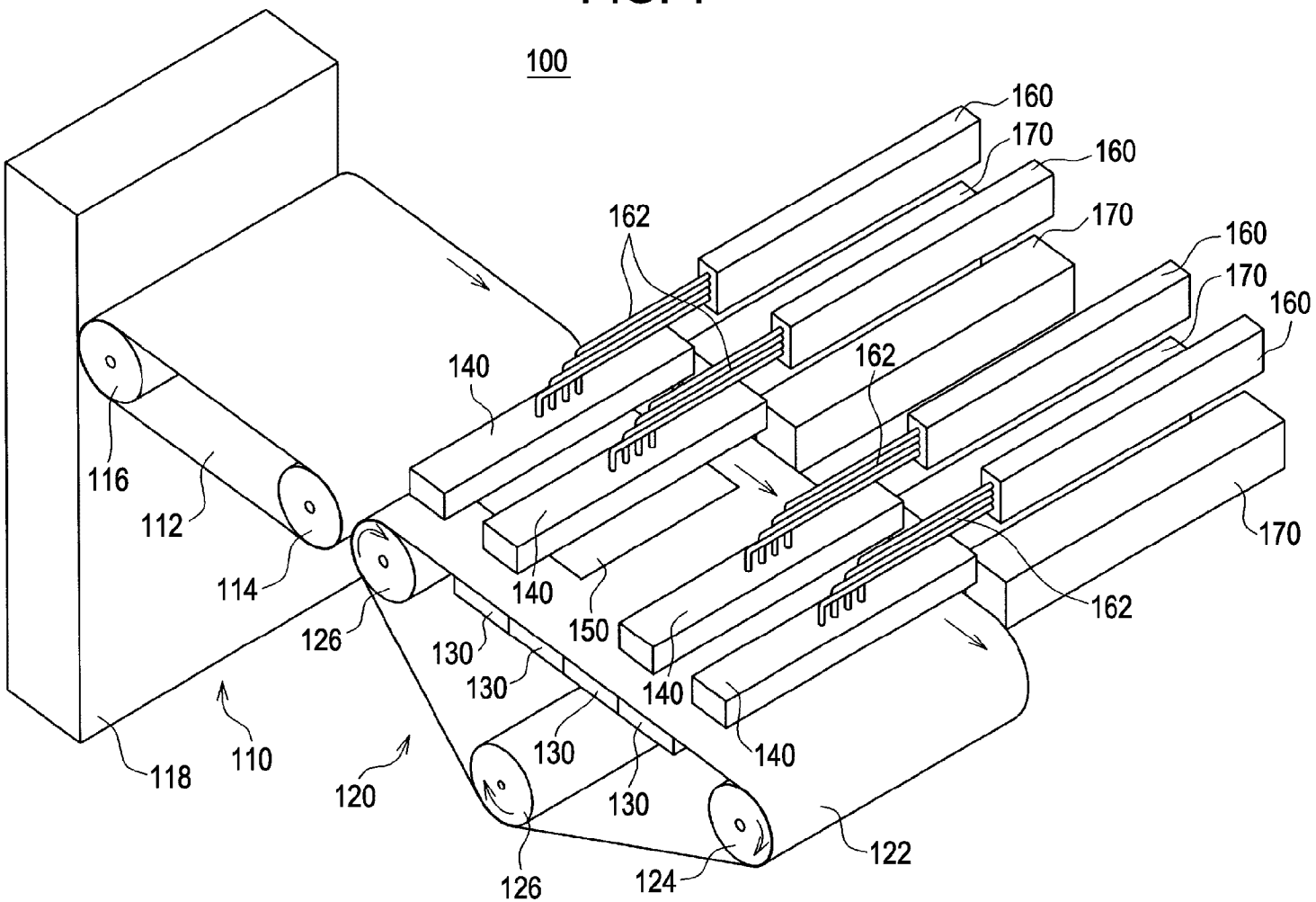
FIG. 1 is a perspective view schematically showing the structure of a printing apparatus.

FIG. 1 is a perspective view schematically showing the structure of a printing apparatus 100. The printing apparatus 100 includes a feed unit 110 and a transporting unit 120 arranged adjacently, and a plurality of printheads 140 arranged above the transporting unit 120.

The feed unit 110 includes an endless belt 112, a drive roll 114, a driven roll 116, and a paper feed unit 118. The paper feed unit 118 stores a plurality of printing papers 150. The endless belt 112 is wound around the drive roll 114 and the driven roll 116 arranged in parallel with each other. The drive roll 114 is driven to rotate by a motor or the like, not shown. Accordingly, the endless belt 112 travels horizontally between the drive roll 114 and the driven roll 116.

The printing papers 150 taken out from the paper feed unit 118 one-by-one by a feeding mechanism, not shown, is placed on the endless belt 112 and is fed to the transporting unit 120. Although not shown in the drawing, the feed unit 110 may include an electrostatic adsorption apparatus or the like for the purpose of causing the printing papers 150 to be adsorbed to the endless belt 112.

The transporting unit 120 includes an endless belt 122, a drive roll 124, and driven rolls 126. The endless belt 122 is wound around the drive roll 124 and the driven rolls 126 arranged in parallel with each other. The drive roll 124 is driven to rotate by a motor or the like, not shown. Accordingly, the endless belt 122 travels horizontally on top of the transporting unit between the drive roll 124 and one of the driven rolls 126.

Above a section where the endless belt 122 travels horizontally, the plurality of printheads 140 are arranged in parallel along the direction of travel of the endless belt 122. In the same section, ink supply units 160 and cleaning units 170 are arranged on the lateral side of the endless belt 122 in terms of the direction of travel. The printheads 140 are joined to the ink supply units 160 via flexible tubes 162 respectively.

The ink supply units 160 are arranged at positions higher than the printheads 140, and the cleaning units 170 are arranged at positions lower than the printheads 140, respectively. Accordingly, the printheads 140 are allowed to move to positions above the cleaning units 170 without being interfered with the ink supply units 160.

Figure 2:
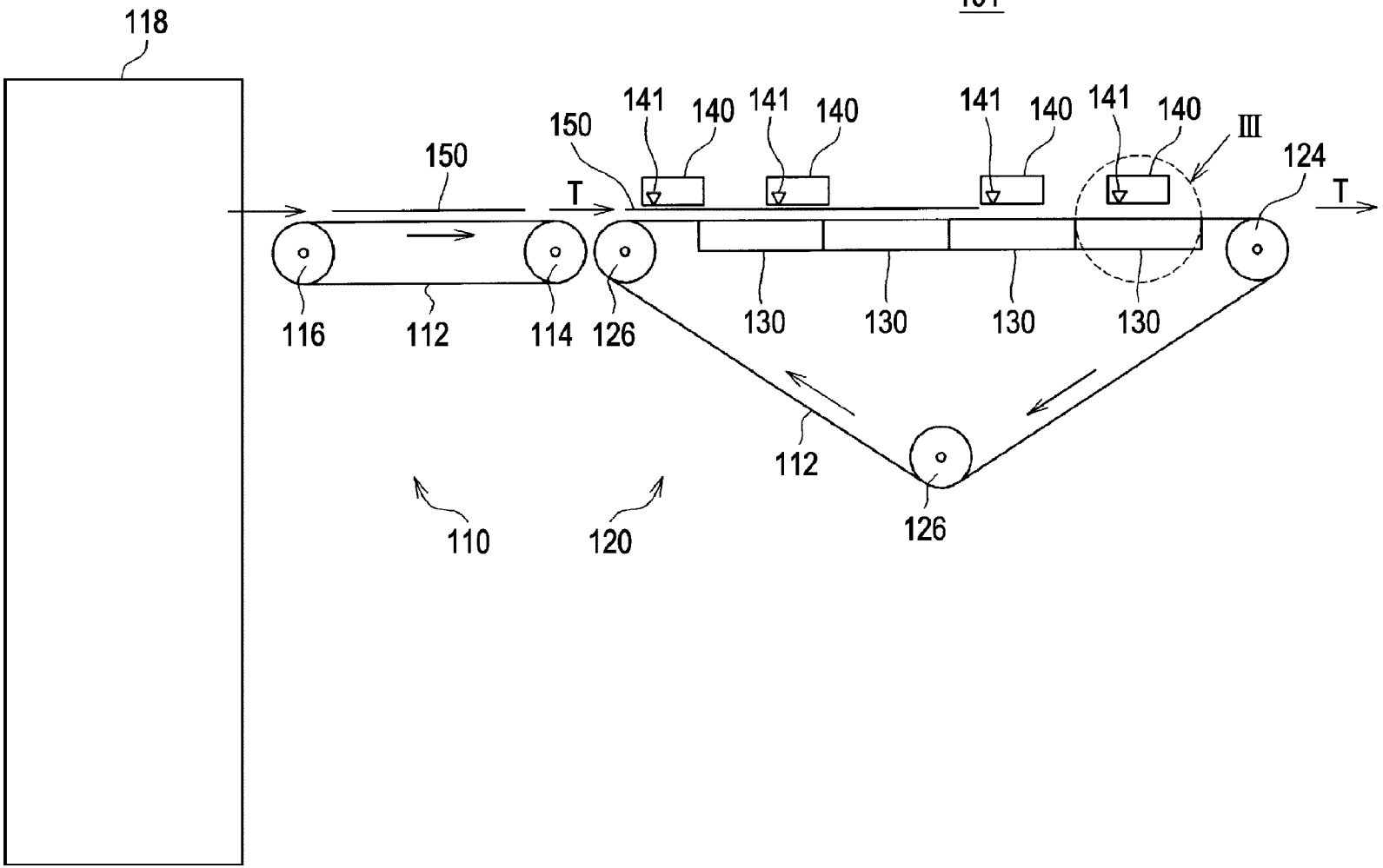
FIG. 2 is a cross-sectional view showing a transport path 101 in the printing apparatus.

FIG. 2 is a cross-sectional view schematically showing a transport path 101 of the printing paper 150 in the printing apparatus 100. The same components as in FIG. 1 are designated by same reference numerals and description will be omitted.

The printing papers 150 are taken out from the paper feed unit 118 one by one, and then are moved substantially horizontally by the feed unit 110 and the transporting unit 120. In the transporting unit 120, ink is discharged from the printheads 140 positioned above the printing paper 150, and an image is formed on an upper surface of the printing paper 150. The ink discharged from the printheads 140 is continuously supplied from the ink supply units 160.

Here, the printheads 140 each include a paper end sensor 141 for detecting that the paper end of the printing paper 150 passing below arrives on the upstream side of the printing paper 150 in terms of the transporting direction T. Accordingly, ink is allowed to be discharged and adhered to accurate positions on the printing paper 150. Also, adsorbing units 130 are arranged below the printheads 140 respectively so as to be in substantially contact with a lower surface of the endless belt 122.

Figure 3:
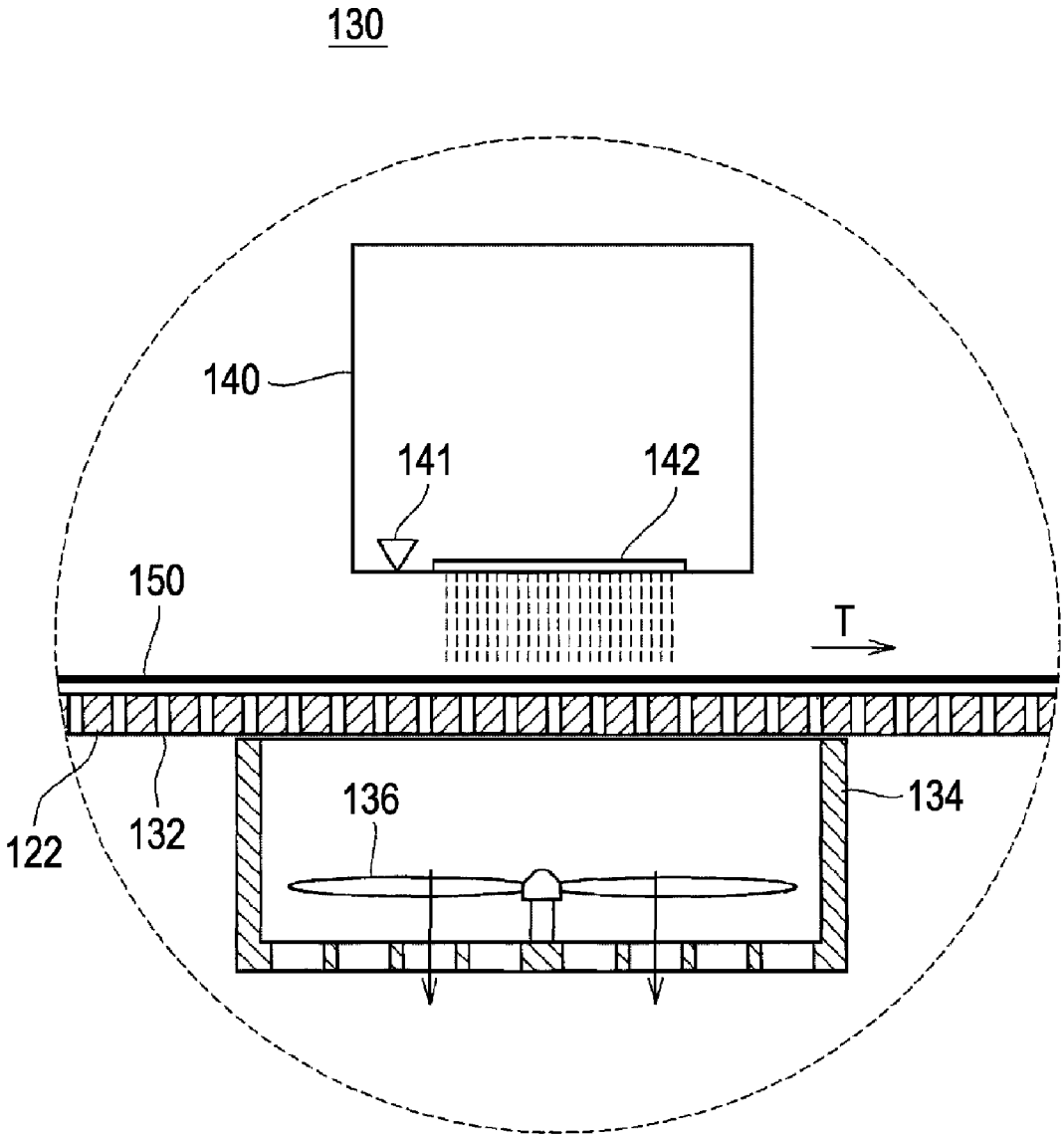
FIG. 3 is a partial cross-sectional view for explaining an action of an adsorbing unit.

FIG. 3 is a partial cross-sectional view for explaining the structure and an action of the adsorbing units 130. A portion indicted in FIG. 3 corresponds to an area III surrounded by a dot line in FIG. 2.

The adsorbing units 130 each include a depressurizing chamber 134 which surrounds the lower surface of the endless belt 122, and an adsorbing fan 136 arranged in the interior of the depressurizing chamber 134. Adsorbing holes 132 formed over the entire surface of the endless belt 122 so as to penetrate through the endless belt 122 from the front surface to the back surface thereof also constitutes part of the adsorbing units 130.

The adsorbing fan 136 discharges air in the interior of the depressurizing chamber 134 out from the depressurizing chamber to generate a negative pressure in the interior of the depressurizing chamber 134. The negative pressure acts on the printing paper 150 on the endless belt 122 via the adsorbing holes 132.

Accordingly, the printing paper 150 is adsorbed by the endless belt 122 and moves together with the travel of the endless belt 122. Therefore, the amount of movement of the printing paper 150 may be controlled accurately by controlling the amount of travel of the endless belt 122, so that the quality of the printed image is improved.

Figure 4:
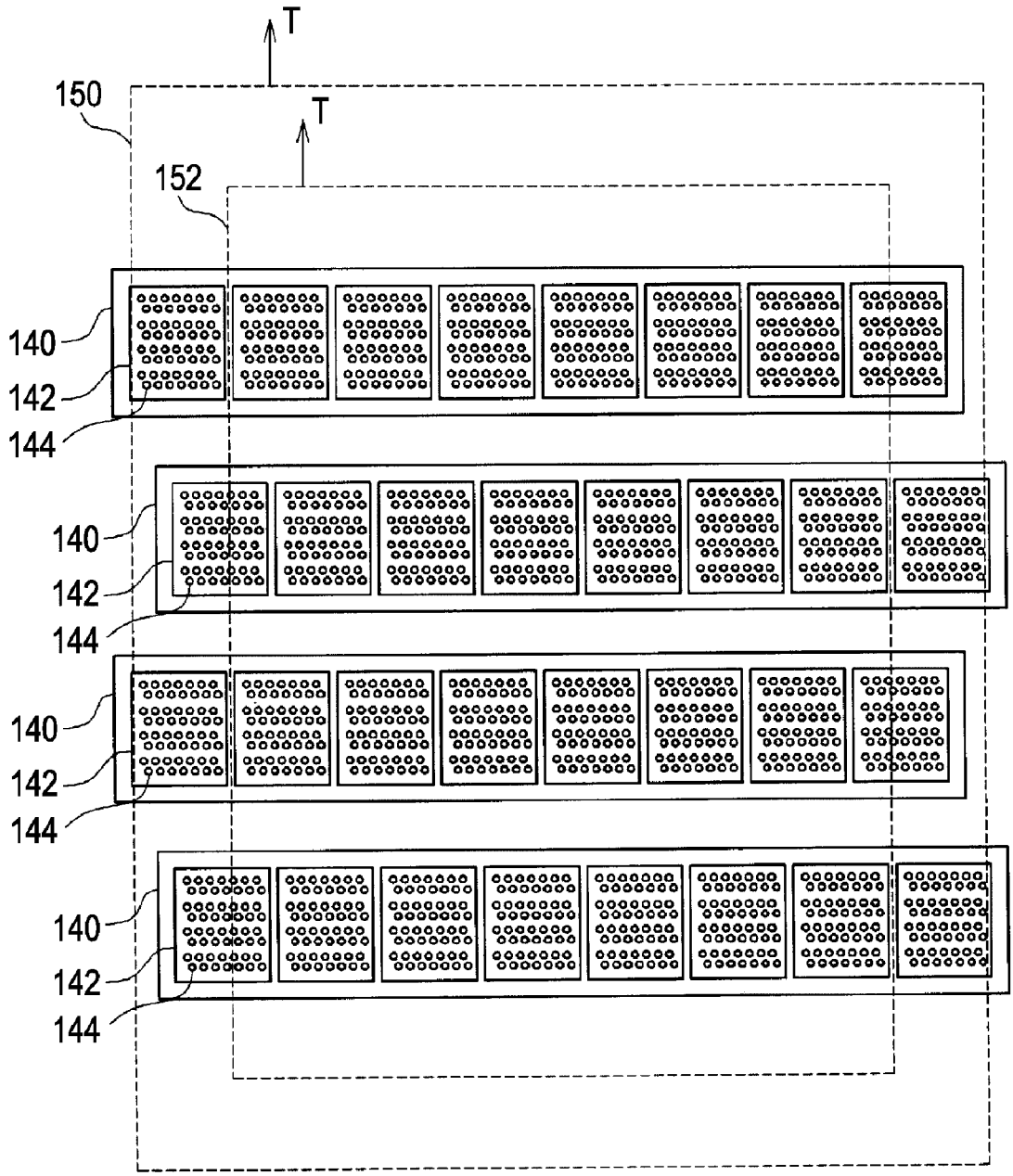
FIG. 4 is a drawing showing the relation between a printing paper and printheads.

FIG. 4 is a drawing showing the dimensional relation between the printing paper 150 and the printheads 140. FIG. 4 is a view of the printheads 140 in the transporting unit 120 from below and the print papers 150 and 152 passing underside thereof are indicated by dot lines.

The respective printheads 140 each include a plurality of nozzle plates 142 arranged on the lower surfaces thereof in the longitudinal direction. The nozzle plates each include a number of nozzles 144. Accordingly, the lower surfaces of the printheads 140 each include the nozzles 144 arranged over the substantially entire length thereof. Each of the nozzle plates 142 discharges ink having colors such as yellow, magenta, cyan, and black respectively from the respective rows of the nozzles 144 to form a color image on the printing paper 150.

The nozzles 144 are formed in a plurality of rows, and each row of the nozzles 144 is arranged so as to be shifted from the adjacent row of the nozzles 144 in the direction of extension of the row. The shifted amount of the rows of the nozzles 144 is set to half a pitch of the nozzles 144, so that the printing resolution of the printheads 140 is practically enhanced while maintaining the distance between the adjacent nozzles to at least a certain distance.

There arises areas where the density of the nozzles 144 is low between the adjacent nozzle plates 142. Therefore, the printheads 140 each are arranged so as to be shifted from the adjacent printheads 140 in the longitudinal direction. Accordingly, the image is printed at a high printing density over the entire width of the printing paper 150.

In the printing apparatus 100 having the printheads 140 as described above, the printing paper 150 is transported in the transporting direction T which is orthogonal to the longitudinal direction of the printheads 140 (hereinafter, referred to as "widthwise direction"). Here, when the printing apparatus 100 prints an image on the narrow printing paper 152, the nozzles 144 positioned on the outer sides of the printheads 140 in the longitudinal direction are positioned outside the printing paper 150, and hence are not involved in the printing of the image.

The printing apparatus 100 discharges ink from the nozzles 144 by a large amount for the purpose of cleaning the nozzles 144 without printing images from time to time. The action as such is referred to as "flushing", which is executed when the printing paper 150 is not loaded.

Figure 5:
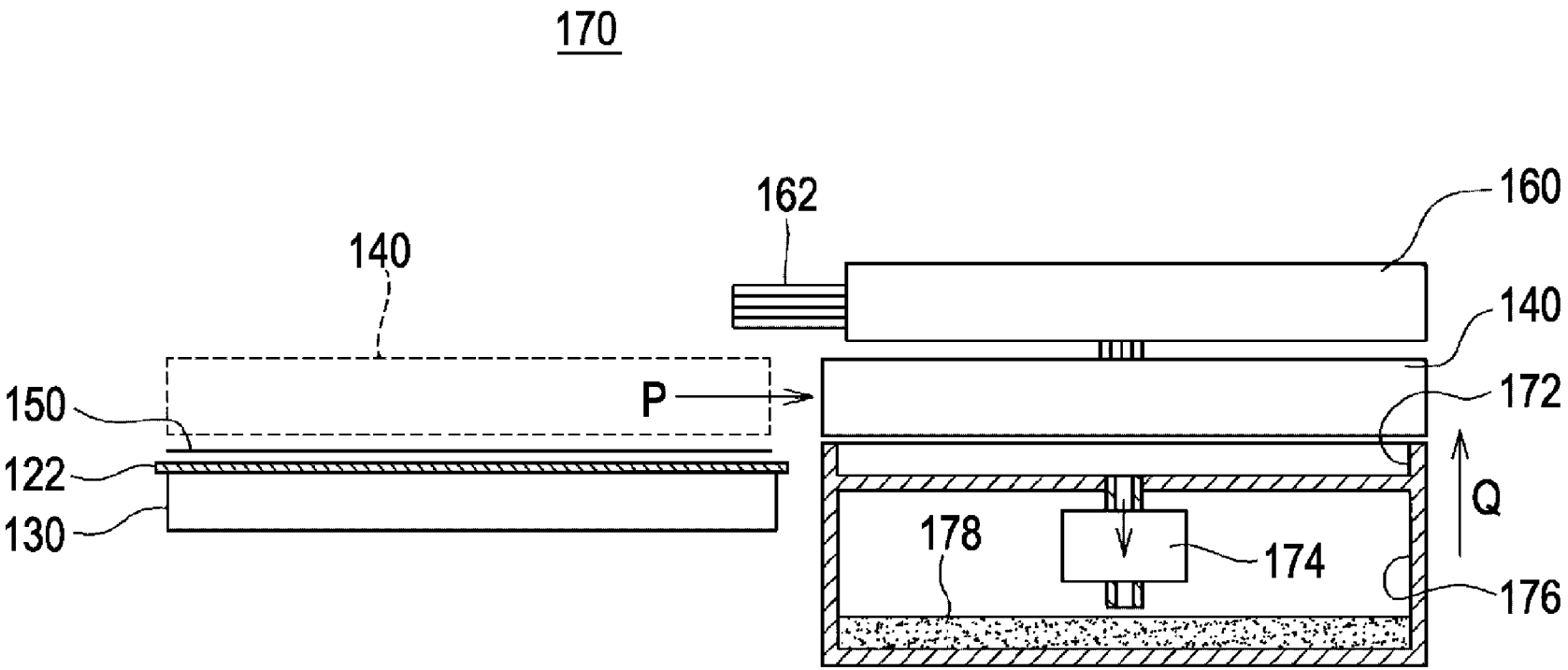
FIG. 5 is a drawing schematically showing the structure of a cleaning unit.

FIG. 5 is a drawing schematically showing the structure and an action of the cleaning units 170 in the printing apparatus 100. The cleaning unit 170 includes a cap portion 172, a suction pump 174, and a liquid storing portion 176.

The cap portion 172 is opened on top, and has a size which is able to cover the lower surface of the printheads 140 substantially hermetically. The suction pump 174 sucks liquid from the interior of the cap portion 172. The liquid storing portion 176 stores the liquid sucked by the suction pump 174. A porous liquid absorbing member 178 is arranged in the interior of the liquid storing portion 176.

The cleaning unit 170 as described above acts as follows. When executing the cleaning operation, the printhead 140 is moved from above the endless belt 122 to above the cap portion 172 as indicated by an arrow P in the drawing. Then, as indicated by an arrow Q, the cleaning unit 170 moves upward and brings the cap portion 172 into abutment with the lower surface of the printheads 140. Accordingly, the nozzles 144 are covered by the cap portion 172 substantially hermetically.

Subsequently, the suction pump 174 is activated to depressurize a space defined by the cap portion 172 and the printhead 140. Accordingly, the ink is forcedly sucked from the interior of the printhead 140 via the nozzles 144. Consequently, the ink increased in viscosity in the interior of the nozzles 144 is forcedly eliminated together with the sucked ink.

The ink sucked into the cap portion 172 is sucked out to the liquid storing portion 176 by the suction pump 174. In the liquid storing portion 176, the ink is absorbed into the liquid absorbing member 178. Accordingly, the ink stored in the liquid storing portion 176 is prevented from flowing out in the case of moving the printing apparatus 100 or the like.

When cleaning the nozzles 144, part of the ink sucked out from the nozzles 144 might adhere to the lower surface of the nozzle plates 142. There is a case where a wiper is provided in the vicinity of the cleaning unit 170 for the purpose of removing such ink. There is also a case where the lower surface of the printhead 140 is sealed by the cap portion 172 when the printing apparatus 100 is not in operation for the purpose of retarding the increase in viscosity of the ink in the nozzles 144.

Figure 6:
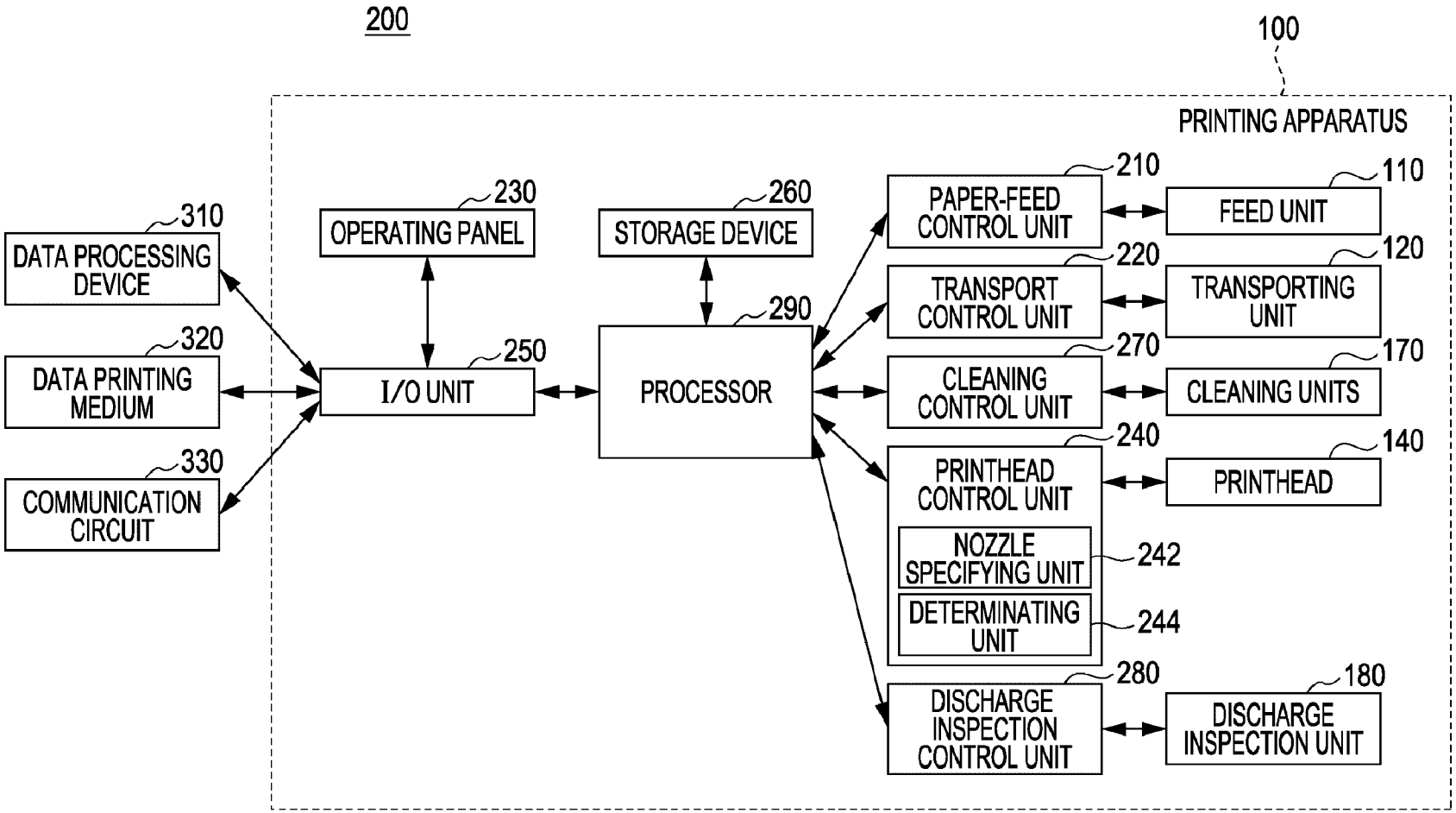
FIG. 6 is a drawing schematically showing the structure of a control system.

FIG. 6 is a drawing schematically showing the structure of the control system 200 of the printing apparatus 100. The control system 200 includes an I/O (input and output) unit 250, a storage device 260, a processor 290, a paper-feed control unit 210, a transport control unit 220, a cleaning control unit 270, a printhead control unit 240, and a discharge inspection control unit 280.

The paper-feed control unit 210, the transport control unit 220, and the cleaning control unit 270 control the actions of the feed unit 110, the transporting unit 120, and the cleaning units 170 which are already described above, respectively. The printhead control unit 240 includes a nozzle specifying unit 242 and a determining unit 244, and controls the action of the printheads 140 involved in printing of images. The discharge inspection control unit 280 controls the action of the discharge inspection unit 180. The actions of the printhead control unit 240 and the discharge inspection control unit 280 will be described later.

The I/O unit 250 constitutes an interface for transmission of signals with respect to the outside. The I/O unit 250 receives entry of instructions from users by the operation of an operating panel 230. In contrast, the storage device 260 and the processor 290 constitute an execution unit, and execute controls by the paper-feed control unit 210, the transport control unit 220, the cleaning control unit 270, the printhead control unit 240, and the discharge inspection control unit 280.

When the printhead control unit 240 issues an instruction to the printheads 140 saying that ink should be discharged, the discharge inspection unit 180 inspects whether the ink is actually discharged from the nozzles 144 which receive the instruction or not. The discharge inspection unit 180 as such may be formed by arranging an electrical or optical sensor in the vicinity of the nozzles as disclosed in JP-A-10-119307. Also, as disclosed in JP-A-2000-272116 described above for example, it may be formed by reading a printing paper 150 having a test pattern printed thereon. The discharge inspection control unit 280 controls the action of the discharge inspection unit 180 as described above.

In this manner, the printing apparatus 100 includes the printheads 140 being arranged along the transport path 101 of the printing paper 150 transported in the transporting direction and having the plurality of nozzles 144 arranged in the direction of arrangement which intersects the transporting direction; the printhead control unit 240 configured to print an image on the printing paper 150 by discharging ink from part of the plurality of nozzles 144 on the basis of given image data; and the discharge inspection unit 180 configured to detect any discharge-defective nozzle present in the plurality of nozzles 144; the printhead control unit 240 including the nozzle specifying unit 242 configured to specify specific nozzles which discharge ink for forming the image and the determining unit 244 configured to determine whether any discharge-defective nozzle is included in the specific nozzle or not, and starting printing of the image when the determining unit 244 determines that no discharge-defective nozzle is included in the specific nozzles. Accordingly, unnecessary cleaning operation is eliminated and quick start of the image printing is achieved as described later.

Figure 7:
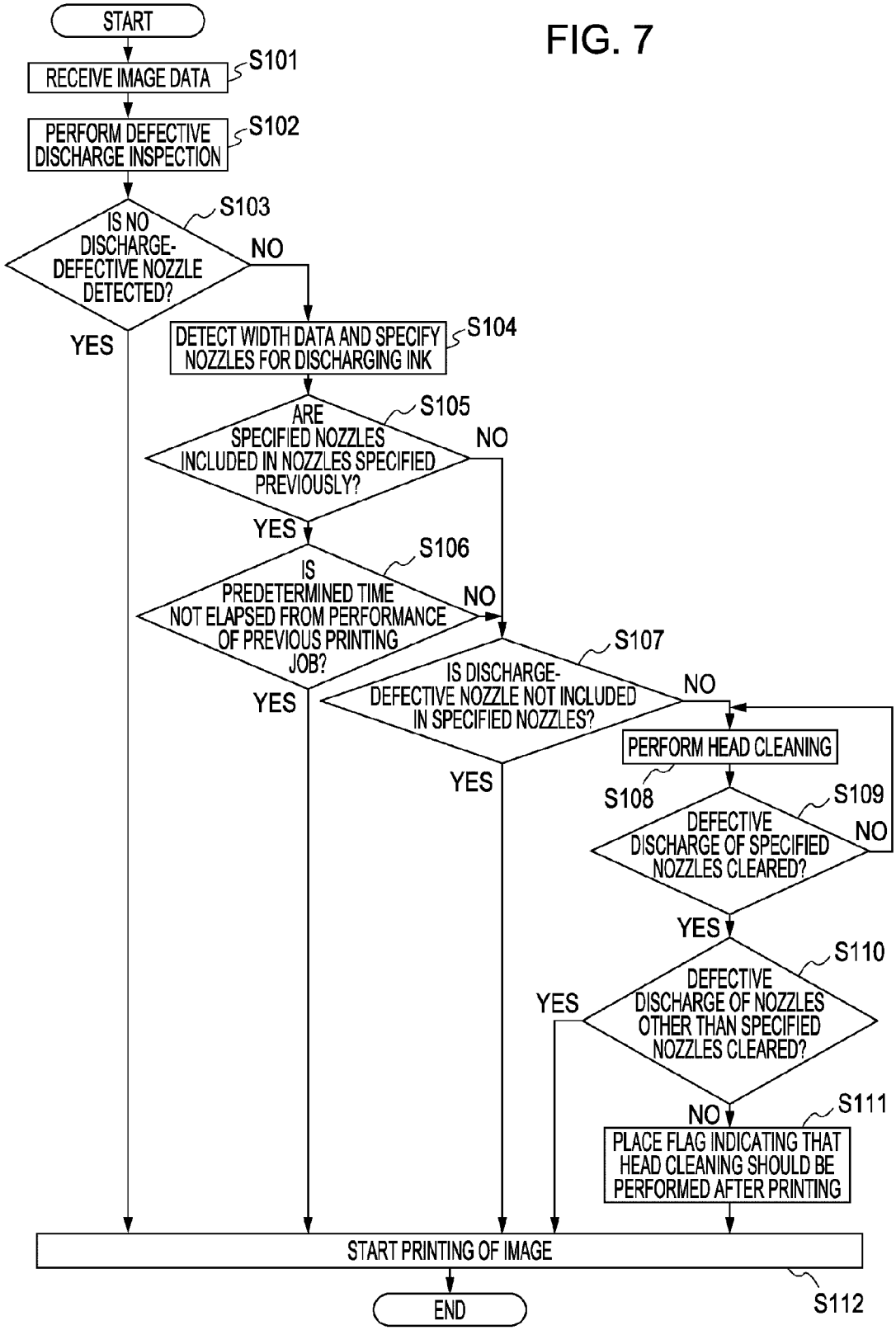
FIG. 7 is a flowchart showing a control procedure to be executed in the printing apparatus.

FIG. 7 is a flowchart showing a control procedure to be executed in the control system 200. The term "START" in FIG. 7 means to start a series of controls which are to be executed prior to printing of images by the printing apparatus 100. The term "END" means that the processes to be executed before starting printing of images are completed, and printing of images is executed after this process.

When the process is started, first of all, the I/O unit 250 receives image data including data of image to be printed (Step S101). Upon reception of the image data, the discharge inspection control unit 280 is triggered to cause the discharge inspection unit 180 to execute a discharge inspection for all the nozzles 144, and stores discharge-defective nozzles being defective in discharge (Step S102). When no discharge-defective nozzle is detected (YES in Step S103), it is informed to the printhead control unit 240, and printing of the image is immediately started (S112). Accordingly, the process time required for the processes to be executed before starting the printing is shortened to a large extent.

In contrast, when any discharge-defective nozzle is detected among the nozzles 144 (NO in Step S103), the nozzle specifying unit 242 refers to, for example, width data of the printing paper 150 extracted from the received image data, and specifies the nozzles 144 to discharge ink for printing the image (Step S104). The width data may also be obtained by calculating the width of the image to be printed from the printing image data generated on the side of the printing apparatus 100.

Here, there is a case where printing of another image has already executed immediately before starting the process involved in printing of an image. In such a case, since the discharge inspection and cleaning described later are already executed for the nozzles 144 used for the previous printing of the image, overlapped process may be omitted. Therefore, the nozzles 144 specified in Step S104 and the nozzles 144 specified in the previous printing operation are compared (Step S105).

When all the nozzles 144 specified this time are included in the nozzles 144 specified previously (YES in Step S105), it is determined that these nozzles 144 are not defective in discharge, or the discharge failure is already cleared. Therefore, the determining unit 244 determines that the specified nozzles 144 include no discharge-defective nozzle (YES in Step S105). Accordingly, the time required for determining the nozzles which are used immediately before and are not defective in discharge again is omitted. Consequently, the process time is shortened.

However, when a considerable time is elapsed from the previous printing operation to the printing operation of this time, or when a considerable amount of printing operation has executed from when the previous printing operation is started until when the printing operation of this time is started, the state of the nozzles 144 might be changed. Therefore, when a time exceeding a predetermined time is elapsed from the previous printing operation (NO in Step S106), the procedure goes back to the normal control process, and the procedure described below is executed. Accordingly, occurrence of discharge failure is reliably prevented.

On the other hand, when the elapsed time from the previous printing operation does not reach the predetermined time (YES in Step S106), it is informed to the printhead control unit 240, and printing of images is started immediately (Step S112). Accordingly, the process time required for the processes to be executed before starting the printing is shortened.

In Step S104, specification of the nozzles 144 may be updated by calculating the difference between the detected width data and the width data involved in the previous printing operation. Accordingly, the processes involved in the specification of the nozzles are reduced.

Step S105 and Step S106 are executed on the condition that a printing operation is executed before, and hence if the printing apparatus 100 is operated for the first time, these steps are omitted. Also, these steps may be omitted when it is apparent that printing of images is not executed immediately before as in the case of a first printing operation after turning the power of the printing apparatus 100 ON.

When the nozzles 144 specified this time are not included in the nozzles 144 specified at the previous time (NO in Step S105), or when a time exceeding the predetermined time is elapsed from the previous printing operation (NO in Step S106), the determining unit 244 determines whether the discharge-defective nozzle detected by the discharge inspection unit 180 is included in the specified nozzles specified by the nozzle specifying unit 242 or not (Step S107). When the discharge-defective nozzle is not included in the specified nozzles (YES in Step S107) it is informed to the printhead control unit 240, and printing of images is started immediately (Step S112). Accordingly, the process time required for the processes to be executed before starting the printing is shortened.

In contrast, when it is determined that the discharge-defective nozzle is included in the specified nozzles (NO in Step S107), the determining unit 244 informs it to the cleaning control unit 270 to cause the cleaning units 170 to execute the cleaning of the nozzles 144 (Step S108). Subsequently, when the cleaning of the nozzles 144 is executed, the discharge inspection unit 180 executes the discharge inspection on the nozzles 144 again (Step S109).

When it is found that any discharge-defective nozzle is still included in the specific nozzles by this discharge inspection (NO in Step S109), the cleaning of the nozzles 144 is executed again (Step S108). By repeating this sequence, the discharge-defective nozzle included the specific nozzles is cleared (YES in Step S109). Therefore, by causing printing of images to be executed in this state (Step S112), printing of high-quality images is achieved.

Even when the discharge failure included in the specified nozzles 144 is cleared (YES in Step S109), there may be a case where the discharge-defective nozzle is still included in the nozzles other than the specified nozzles. The presence of the discharge-defective nozzle is stored in the discharge inspection unit 180.

Therefore, when any discharge-defective nozzle is present in the nozzles 144 other than the specific nozzles (NO in Step S110), a flag indicating it may be set (Step S111) before executing the printing operation (Step S112). Therefore, after having completed the printing of the image, the cleaning of the nozzles 144 may be executed by referring to the flag to clear all the discharge-defective nozzles. In contrast, when no discharge-defective nozzle is present in the nozzles 144 other than the specific nozzles (YES in Step S110), printing of images is executed directly (Step S112).

In this manner, images are printed in the state in which the discharge failure is solved in the specified nozzles 114, and hence printing of high-quality images is achieved. Also, since printing of images is started in the state in which the discharge failure is solved in the specified nozzles 114, improvement of the throughput involved in the printing of images is achieved.

When printing an image by the specified nozzles 144 by the printing apparatus 100, the printhead control unit 240 may cause the nozzles 144 which are not specified by the nozzle specifying unit 242 to discharge ink which does not form any image. Accordingly, the flushing of the nozzles not in use is achieved in parallel with the image printing operation, so that lowering of the frequency of occurrence of the discharge failure is achieved for all the nozzles 144. Also, even in the case where the nozzles 144 which are not specified by the nozzle specifying unit 242 are defective in discharge, by causing ink which does not form any image in parallel with printing of images to be discharged, the time until other processes which are to be executed after having cleared the discharge failure (such as printing using the nozzles having been defective in discharge) is executed may be shortened in comparison with the case where the flushing process only for the purpose of clearing the discharge failure is provided separately. However, when the width data detected in Step S102 is the width of the image to be printed instead of the width of the printing paper 150, the nozzles 144 for which the parallel flashing as described above is to be executed are limited to the nozzles 144 located outside the width of the printing paper 150. Also, the printing apparatus 100 may be provided with at least one of the bordered print mode and the borderless print mode. In the bordered print mode, for example, the printhead control unit 240 detects the width of the printing paper and the width of the image to be printed as the width data in Step S102, determines whether the position of the discharge-defective nozzle which does not form any image (hereinafter, referred to as "non-output defective nozzle") corresponds to the position on the printing paper or not, and, if it corresponds to the position on the printing paper, does not cause ink to be discharged from the non-output defective nozzle in parallel with printing of the image and, if the non-output defective nozzle corresponds to the position out of the printing paper, causes the ink which does not form any image to be discharged from the non-output defective nozzle (for clearing the discharge failure) in parallel with printing of the image. In contrast in the borderless print mode, the process of determining whether the position of the non-output defective nozzle corresponds to the position on the printing medium may be omitted. More specifically, determination of the specific nozzles in the borderless print mode may be as follows. In the borderless print mode, since the ink is discharged also to portions which lie off the printing paper, the discharge-defective nozzle (non-output defective nozzle) corresponding to the position out of the printing paper may be specified on the basis of the width of the printing paper instead of the width of the image to be printed. Alternatively, the conditions of determination of the specific nozzles may be determined depending on whether the position of the nozzle to be determined corresponds to an area outside a predetermined area from an area which lies off the width of the printing paper or not instead of whether it corresponds the printing paper or not. In the latter case, even when the printing paper is skewed, only the nozzles corresponding to the position out of the printing paper may be set as the nozzles for discharging the ink which does not form any image in parallel with the printing of the image.

It is also possible to provide a step of executing the cleaning for all the nozzles 144 immediately after having turning the power of the printing apparatus 100 ON. Accordingly, the discharge failure caused by increased viscosity of the like of ink occurring during downtime is cleared, and hence the percentage of detection of the discharge failure during the series of control processes is reduced. Therefore, improvement of the throughput of the actions involved in printing of images is achieved.

In addition, when data which specifies a printing paper 150 of a different size is included in image data that the I/O unit 250 receives, or when a plurality of image data which specify printing papers 150 having sized different from each other that the I/O unit 250 receives are buffered in the storage device 260, the printhead control unit may extract image data in which the printing papers 150 of the same size are specified and print the corresponding image data continuously.

In other words, it is also possible to rearrange the plurality of image data to classify image data into image groups by the width. Alternatively, it is also possible to process from the image group of the large size to the image group of the small size in sequence. Accordingly, the number of times of the process that the nozzle specifying unit 242 executes for specifying the nozzles and the number of times of the cleaning that the cleaning control unit 270 executes are reduced when the discharge failure is detected, whereby improvement of the throughput of printing images is achieved.

In this manner, the method of controlling the printing apparatus 100 including the printheads 140 being arranged along the transport path 101 of the printing paper 150 transported in the transporting direction and having the plurality of nozzles 144 arranged in the direction of arrangement which intersects the transporting direction; and the printhead control unit 240 configured to print an image on the printing paper 150 by discharging ink from part of the plurality of nozzles 144 on the basis of given image data, includes: detecting a discharge-defective nozzle from the plurality of nozzles 144; specifying specific nozzles which discharge ink for printing an image; and determining whether the specific nozzles include any discharge-defective nozzle or not, and printing of the image is started when the determining unit 244 determines that the specific nozzles do not include the discharge-defective nozzle is executed.

Although the invention has been described on the basis of the embodiment, the technical scope of the invention is not limited by the scope of description in the embodiment described above. It is apparent by those skills in the art that various modifications or improvements may be made. It is apparent from the description in attached claims that the modes modified and improved are also included in the technical scope of the invention.

What is claimed is:

1. A printing apparatus comprising:

printheads being arranged along a transport path of a printing medium transported in a transporting direction and having a plurality of nozzles arranged in a direction of arrangement which intersects the transporting direction;

a printhead control unit configured to print an image on the printing medium by discharging ink from the plurality of nozzles on the basis of given image data; and a discharge inspection unit configured to detect any discharge-defective nozzle present in the plurality of nozzles, the printhead control unit specifying specific nozzles which discharge ink for printing the image, determining whether any discharge-defective nozzle is included in the specific nozzles or not, and starting printing of the image when it is determined that no discharge-defective nozzle is included in the specific nozzles, wherein the printhead control unit determines which nozzles are not determined as the specific nozzles and include discharge failures as non-output defective nozzles, and causes the non-output defective nozzles to discharge ink which does not form any image in parallel with the printing of the image, and wherein the printhead control unit determines whether the position of the non-output defective nozzle would cause the non-output defective nozzle to discharge ink on the printing medium or not on the basis of the image data and data on the size of the printing medium and, when the position of the non-output defective nozzle corresponds to the position on the printing medium, does not cause the non-output defective nozzle to discharge ink in parallel with the printing of the image and, when the position of the non-output defective nozzle corresponds to the position out of the printing medium, causes the non-output defective nozzle to discharge ink in order to clear the discharge failure in parallel with the printing of the image.

2. The printing apparatus according to claim 1, wherein when a series of image data for a plurality of printing media including specifications of printing media having different sizes in the direction of arrangement is given, the printhead control unit extracts image data in which the printing media of the same size are specified and causes the images to be printed continuously.

3. The printing apparatus according to claim 1, wherein when the specific nozzles include any discharge-defective nozzle, the printhead control unit causes a cleaning of the plurality of nozzles to be executed.

4. A method of controlling a printing apparatus including printheads being arranged along a transport path of a printing medium transported in a transporting direction and having a plurality of nozzles arranged in the direction of arrangement which intersects the transporting direction and printhead control unit configured to print an image on the printing medium by discharging ink from the plurality of nozzles on the basis of given image data, the method comprising:

detecting a discharge-defective nozzle present among the plurality of nozzles;

specifying specific nozzles which discharge ink when printing the image; and determining whether the specific nozzles include the discharge-defective nozzle or not, determining which nozzles among the plurality of nozzles are not determined as the specific nozzles and include discharge failures as non-output defective nozzles, causing the non-output defective nozzles to discharge ink which does not form any image in parallel with the printing of the image, determining whether the position of the non-output defective nozzle would cause the non-output defective nozzle to discharge ink on the printing medium or not on the basis of the image data and data on the size of the printing medium, and when the position of the non-output defective nozzle corresponds to the position on the printing medium, causing the non-output defective nozzle not to discharge ink in parallel with the printing of the image and, when the position of the non-output defective nozzle corresponds to the position out of the printing medium, causing the non-output defective nozzle to discharge ink in order to clear the discharge failure in parallel with the printing of the image, wherein printing of the image is started when a determining unit determines that the specific nozzles do not include any discharge-defective nozzle in the step of determining.

* * * * *